US009957844B2

(12) United States Patent
Kobayashi et al.

(10) Patent No.: US 9,957,844 B2
(45) Date of Patent: May 1, 2018

(54) POWER GENERATION SYSTEM, AND MAINTENANCE METHOD FOR POWER GENERATION SYSTEM

(71) Applicant: MITSUBISHI HEAVY INDUSTRIES, LTD., Tokyo (JP)

(72) Inventors: Naoki Kobayashi, Tokyo (JP); Toyotaka Hirao, Tokyo (JP); Taichi Tateishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 188 days.

(21) Appl. No.: 14/652,204

(22) PCT Filed: Dec. 27, 2013

(86) PCT No.: PCT/JP2013/085114
§ 371 (c)(1),
(2) Date: Jun. 15, 2015

(87) PCT Pub. No.: WO2014/104297
PCT Pub. Date: Jul. 3, 2014

(65) Prior Publication Data

US 2015/0330259 A1 Nov. 19, 2015

(30) Foreign Application Priority Data

Dec. 28, 2012 (JP) ..... 2012-288964

(51) Int. Cl.
*F01K 13/02* (2006.01)
*F01K 25/10* (2006.01)
(Continued)

(52) U.S. Cl.
CPC ..... *F01K 13/02* (2013.01); *F01D 21/00* (2013.01); *F01K 25/10* (2013.01); *F01D 25/285* (2013.01);
(Continued)

(58) Field of Classification Search
CPC ..... F01K 13/00; F01K 13/02
(Continued)

(56) References Cited

U.S. PATENT DOCUMENTS

2001/0032109 A1* 10/2001 Gonyea ..... G06Q 10/06 705/400
2006/0059904 A1* 3/2006 Shevket ..... B60K 7/0015 60/325
(Continued)

FOREIGN PATENT DOCUMENTS

CN 1914292 2/2007
CN 101163869 4/2008
(Continued)

OTHER PUBLICATIONS

International Search Report dated Apr. 8, 2014 in corresponding International Application No. PCT/JP2013/085114.
(Continued)

*Primary Examiner* — Laert Dounis
(74) *Attorney, Agent, or Firm* — Wenderoth, Lind & Ponack, L.L.P.

(57) ABSTRACT

A power generation system includes a first on-off valve that, with respect to a maintenance target device including at least one of a circulation pump, an evaporator, an expander, and a condenser in a medium circuit through which a medium with a boiling point lower than that of water circulates, is on an upstream side in a flow direction of the medium in the medium circuit, and is capable of shutting off the flow of the medium; a second on-off valve that is on a downstream side in the flow direction of the medium in the medium circuit, and is capable of shutting off the flow of the medium; a port that is communicable with the medium circuit between the first on-off valve and the second on-off valve; and a third on-off valve that is in the port.

3 Claims, 4 Drawing Sheets

(51) Int. Cl.
*F01D 21/00* (2006.01)
*F01D 25/28* (2006.01)

(52) U.S. Cl.
CPC ..... *F05D 2230/72* (2013.01); *F05D 2230/80* (2013.01); *F05D 2260/02* (2013.01)

(58) Field of Classification Search
USPC ..... 60/657, 641.1–683
See application file for complete search history.

(56) References Cited

U.S. PATENT DOCUMENTS

| | | | | |
|---|---|---|---|---|
| 2007/0151603 | A1* | 7/2007 | McCully | B08B 9/055 137/171 |
| 2010/0257860 | A1* | 10/2010 | Feller | F01K 13/006 60/646 |
| 2011/0072819 | A1 | 3/2011 | Silva et al. | |
| 2011/0173979 | A1* | 7/2011 | Krull | F03G 7/05 60/641.7 |
| 2014/0265328 | A1* | 9/2014 | Van Blerk | F03B 11/004 290/43 |

FOREIGN PATENT DOCUMENTS

| | | | | |
|---|---|---|---|---|
| CN | 102482950 | | 5/2012 | |
| JP | 54-1741 | | 1/1979 | |
| JP | 54001741 | A * | 1/1979 | |
| JP | 55-72615 | | 5/1980 | |
| JP | 58-144613 | | 8/1983 | |
| JP | 59-5814 | | 1/1984 | |
| JP | 64-53006 | | 3/1989 | |
| JP | 01106904 | A * | 4/1989 | |
| JP | 1-285607 | | 11/1989 | |
| JP | 2003-302128 | | 10/2003 | |
| JP | 2005-2950 | | 1/2005 | |
| JP | 2005-240776 | | 9/2005 | |
| JP | 2006-299996 | | 11/2006 | |
| JP | 2006-313048 | | 11/2006 | |
| JP | 2006-313049 | | 11/2006 | |
| JP | 2008-144456 | | 6/2008 | |
| JP | 2008-175108 | | 7/2008 | |
| JP | 2008175108 | A * | 7/2008 | |
| JP | 2009-210185 | | 9/2009 | |
| JP | 2011-17464 | | 1/2011 | |
| JP | 2012-197629 | | 10/2012 | |
| JP | 2012197629 | A * | 10/2012 | E03B 7/02 |

OTHER PUBLICATIONS

Written Opinion of the International Searching Authority dated Apr. 8, 2014 in corresponding International Application No. PCT/JP2013/085114.
First Office Action dated Nov. 4, 2015 in Chinese Application No. 201380066064.5 (with English translation).
Notice of Reasons for Rejection dated Jun. 7, 2016 in corresponding Japanese Application No. 2012-288964 (with English translation).
Notice of Reasons for Rejection dated Jan. 24, 2017 in Japanese Application No. 2012-288964, with English translation.

* cited by examiner

POWER GENERATION SYSTEM, AND MAINTENANCE METHOD FOR POWER GENERATION SYSTEM

CROSS-REFERENCE TO RELATED APPLICATION

Priority is claimed from Japanese Patent Application No. 2012-288964, filed Dec. 28, 2012, the content of which is incorporated herein by reference.

TECHNICAL FIELD

The present invention relates to a power generation system that performs power generation, using exhaust heat from vessels, factories, gas turbines, or the like, the heat of the earth, solar heat, temperature difference between cooler deep and warmer shallow ocean waters, and the like as heat sources, and a maintenance method for a power generation system.

BACKGROUND ART

In recent years, Rankine cycle type power generation systems have been considered as power generation systems that perform power generation, using exhaust heat from vessels, factories, gas turbines, or the like, the heat of the earth, solar heat, temperature difference between cooler deep and warmer shallow ocean waters, and the like as heat sources, from viewpoints of effective energy use, environmental preservation, or the like (for example, refer to Japanese Unexamined Patent Application, First Publication No. 2006-299996; Japanese Unexamined Patent Application, First Publication No. 2006-313048; and Japanese Unexamined Patent Application, First Publication No. 2006-313049). In this case, when the heat sources as described above are used, for example, organic fluids that are media (for example, chlorofluorocarbon media or the like) having a boiling point lower than that of water are used.

In such power generation systems, as shown in FIG. 4, a medium circulates within a cycle circuit 5 having a preheater 1, an evaporator 2, a turbine 3, and a condenser 4, using a circulation pump 6.

A heat medium that has recovered heat from the heat sources as described above is sent into the evaporator 2, is made to perform heat exchange with the medium, and evaporates and gasifies the medium. Additionally, the heat medium that has passed through the evaporator 2 preheats the medium in the preheater 1 provided in the preceding stage of the evaporator 2.

The gasified medium expands in the turbine 3, thereby rotationally driving a main shaft 3*a* and driving a generator 7. The medium that has expanded in the turbine 3 is condensed in the condenser 4 and returns to the circulation pump 6.

An alternating current (AC) output as the generator 7 is driven is converted into a direct current (DC) in a rectifier 9, and the converted direct current is re-converted into an alternating current in a system interconnection inverter 10 and is output to the outside as generated electric power.

TECHNICAL PROBLEM

In the power generation systems as described above, for example, it is necessary to perform maintenance, such as checking or replacement of consumable parts, such as bearings of the main shaft 3*a* of the turbine 3 or the like.

In this case, it is necessary to recover the medium within the cycle circuit 5 prior to maintenance from the viewpoints of environmental preservation, medium cost, or the like.

However, the amount of the medium within the cycle circuit 5 in the above power generation systems is large, and substantial time for recovery of the medium, vacuuming when the inside of the cycle circuit 5 is filled with the medium after the end of the maintenance, or the like is required.

As a result, since a maintenance period is prolonged, and the entire power generation system cannot be used during that time, an operation rate decreases, and economic loss is also large.

The invention provides a power generation system and a maintenance method for a power generation system that can shorten a maintenance period and enhance the operation rate of a power generation system.

SUMMARY OF INVENTION

Technical Solution

According to a first aspect of the invention, a power generation system includes an evaporator configured to heat the medium using heat of an external source so as to evaporate the medium; an expander configured to be driven using the medium evaporated by the evaporator; a condenser configured to condense the medium discharged from the expander; a generator configured to be driven by the expander to generate power; a first on-off valve installed on the medium circuit at an upstream side of a maintenance target device including at least one of the circulation pump, the evaporator, the expander, and the condenser, and is capable of shutting off the flow of the medium through the medium circuit; a second on-off valve installed on the medium circuit at a downstream side of the maintenance target device, and is capable of shutting off the flow of the medium through the medium circuit; a port configured to be communicable with the medium circuit between the first on-off valve and the second on-off valve; and a third on-off valve installed on the port.

According to the power generation system, when the maintenance target device is maintained, after the first on-off valve and the second on-off valve are closed, the third on-off valve is opened to recover the medium between the first on-off valve and the second on-off valve after the medium recovery device that recovers the medium is connected to the port. Then, after the maintenance of the maintenance target device is completed, the section between the first on-off valve and the second on-off valve is vacuumed by connecting the vacuum pump to the port, and the third on-off valve is closed. Next, the third on-off valve is opened by connecting the medium supply device that supplies the medium to the port, the section between the first on-off valve and the second on-off valve is filled with the medium from the medium supply device, and then the third on-off valve is closed. Then, the power generation system is restarted by opening the first on-off valve and the second on-off valve and starting the circulation pump.

In this way, when the maintenance target device is maintained, it is not necessary to extract the medium in the entire medium circuit, and only the medium between the first on-off valve and the second on-off valve may be extracted. Additionally, the vacuuming performed when the filling with the medium is performed after maintenance may also be performed between the first on-off valve and the second on-off valve.

The maintenance target device may include at least one of the circulation pump, the evaporator, the expander, and the condenser or may include two or more among these. Additionally, the two or more maintenance target devices may include the first on-off valve, the second on-off valve, the port, and the third on-off valve.

According to a second aspect of the invention, a plurality of sets of power generation units each including the medium circuit, the circulation pump, the evaporator, the expander, the condenser, and the generator may be provided in parallel, and the first on-off valve, the second on-off valve, the port, and the third on-off valve may be installed on the medium circuit of each of the power generation units.

Accordingly, even in the configuration in which the plurality of medium circuits are provided in parallel, maintenance can be similarly performed in the respective medium circuits.

According to a third aspect of the invention, the medium circuit may branch into a plurality of branched pipes between the downstream side of the evaporator and the upstream side of the condenser, and the maintenance target device, the first on-off valve, the second on-off valve, the port, and the third on-off valve may be installed on each of the branched pipes.

Accordingly, even in the configuration in which the plurality of sets of maintenance target devices are provided in parallel in one medium circuit, maintenance can be performed in a manner similar to the above for the respective maintenance target devices.

According to a fourth aspect of the invention, the power generation system may further include an operating time measuring unit configured to measure an integrated value of the operating time of the maintenance target device, and an operating time monitoring unit configured to output a predetermined signal when the integrated value in the operating time measuring unit reaches a predetermined specified value.

In this way, if the integrated value of the operating time of the maintenance target device reaches the specified value, the operating time monitoring unit can output a predetermined signal, for example, through lighting of an indicator lamp, generation of an alarm sound, or the like, and maintenance can be performed at a suitable timing.

According to a fifth aspect of the invention, a plurality of the maintenance target devices may be provided in parallel, the power generation system may further include the control unit that increases or reduces the number of maintenance target devices to be operated in accordance with the input from the heat source or the output from the generator, and the control unit may preferentially stop the operation of the maintenance target device in which the integrated value of the operating time in the operating time measuring unit is highest when the number of maintenance target devices to be operated is reduced.

As described above, when the plurality of maintenance target devices are provided in parallel for every medium circuit or when the plurality of maintenance target devices are provided in parallel in one medium circuit, the operating times of the maintenance target devices can be constant by preferentially stopping the operation of a maintenance target device having the longest operating time. Accordingly, the maintenance timings of the maintenance target device can be brought close to each other, and maintenance can be efficiently performed.

According to a sixth aspect of the invention, there is provided the maintenance method for the above-described power generation system, the method includes the step of: stopping the circulation pump corresponding the maintenance target device and closing the first on-off valve on the upstream side of the maintenance target device and the second on-off valve on the downstream side of the maintenance target device; opening the third on-off valve and recovering the medium between the first on-off valve and the second on-off valve after a medium recovery device that recovers the medium is connected to the port; closing the third on-off valve after a section between the first on-off valve and the second on-off valve is vacuumed after the maintenance of the maintenance target device is completed; and connecting a medium supply device that supplies the medium to the port, opening the third on-off valve, and filling the section between the first on-off valve and the second on-off valve with the medium from the medium supply device.

According to this method, when the maintenance target device is maintained, it is not necessary to extract the medium in the entire medium circuit, and only the medium between the first on-off valve and the second on-off valve may be extracted. Additionally, even when the filling with the medium is performed after maintenance, the vacuuming may be performed only between the first on-off valve and the second on-off valve.

Advantageous Effects of Invention

According to the above aspects, when a maintenance target device is maintained, it is not necessary to extract or vacuum the medium in the entire medium circuit. Thus, it is possible to shorten a maintenance period and enhance the operation rate of the power generation system.

DESCRIPTION OF EMBODIMENTS

Hereinafter, embodiments for carrying out a power generation system, and a maintenance method for a power generation system according to the invention will be described with reference to the accompanying drawings. However, the invention is not limited only to these embodiments.

First Embodiment

Figure 1:
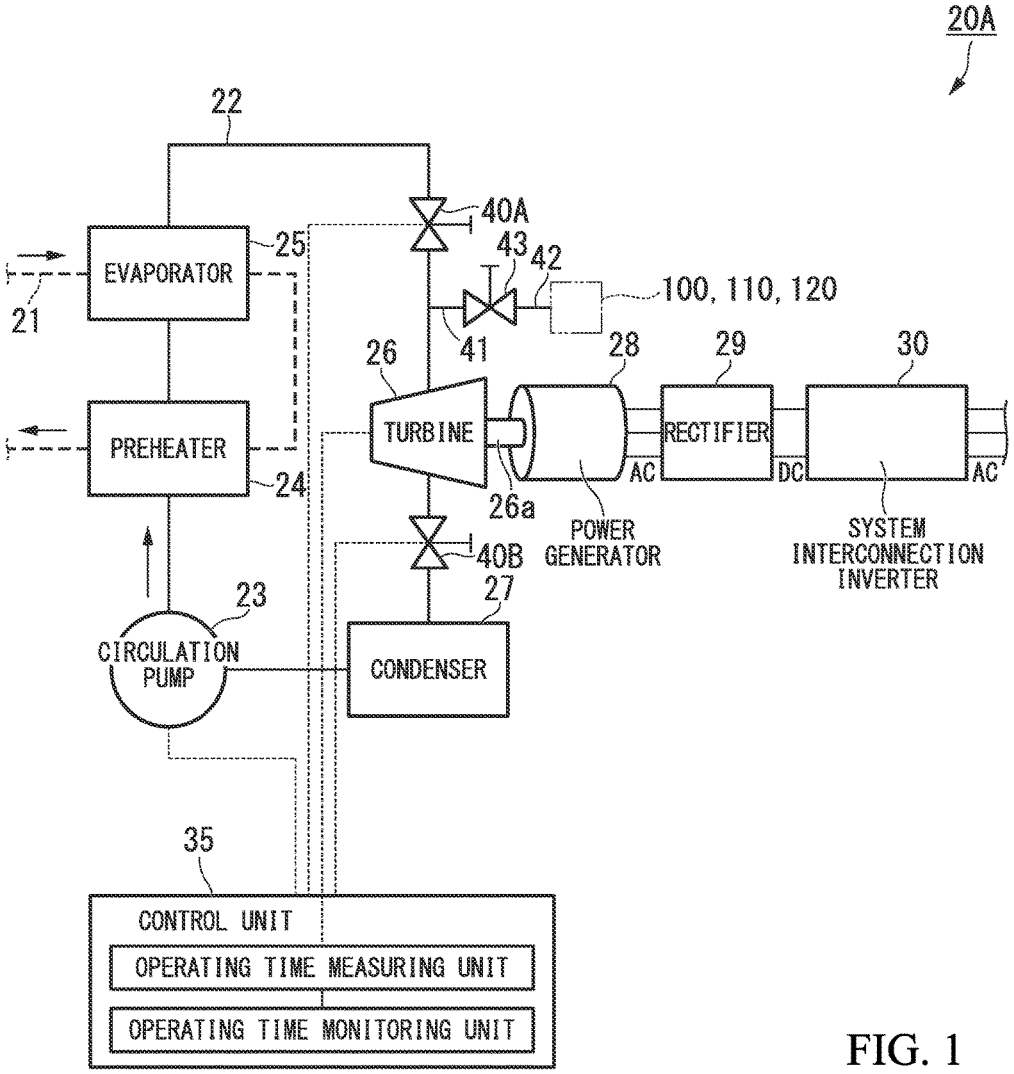
FIG. 1 is a view showing the configuration of a power generation system according to a first embodiment of the invention.

As shown in FIG. 1, a power generation system 20A includes a heat medium circuit 21 into which a heat medium is sent from a heat source, such as exhaust heat from vessels, factories, gas turbines, or the like, the heat of the earth, solar heat, or temperature difference between cooler deep and warmer shallow ocean waters, and a medium circuit 22 through which a medium performing heat exchange with the heat medium of the heat medium circuit 21 circulates, thereby obtaining heat energy.

Here, chlorofluorocarbon media, such as HFC-134a, HFC245fa, HFO-1234yf, and HFO-1234ze, can be used as the medium of the medium circuit 22.

The heat medium circuit 21 supplies heat media, such as steam and water (hot water), which are obtained by recovering heat from heat sources.

The medium circuit 22 includes a circulation pump 23, a preheater 24, an evaporator 25, a turbine (expander) 26, and a condenser 27.

The circulation pump 23 circulates the medium within the medium circuit 22 so as to compress and send out the medium, thereby causing the medium to pass through the preheater 24, the evaporator 25, the turbine 26, and the condenser 27 in order.

The preheater 24 and the evaporator 25 perform heat exchange between the heat medium of the heat medium circuit 21 and the medium of the medium circuit 22, the evaporator 25 heats and evaporates the pressurized medium through heat exchange with the heat medium (external heat source), and the preheater 24 preheats the medium with the remaining heat of the heat medium that has passed through the evaporator 25.

The turbine 26 rotationally drives a main shaft 26*a* around an axis thereof as the medium expands within a turbine chamber. A rotor (not shown) of a generator 28 is coupled to the main shaft 26*a*, and the rotor (not shown) is rotationally driven while facing a stator (not shown) of the generator 28. Accordingly, an alternating current is output in the generator 28.

The alternating current output from the generator 28 is converted into a direct current in a rectifier 29, and the converted direct current is re-converted into an alternating current in a system interconnection inverter 30 and is output to an external power grid as generated electric power.

In such a medium circuit 22, an on-off valve (first on-off valve) 40A and an on-off valve (second on-off valve) 40B are provided on the upstream side and the downstream side of a maintenance target device, for example, the turbine 26.

Additionally, in the medium circuit 22, a port pipe 41 is provided between the on-off valves 40A and 40B, and a tip of the port pipe 41 is communicable with the medium circuit 22, and serves as a service port (port) 42 to which a device for allowing the medium to enter or leave the medium circuit 22 is connectable. Additionally, the port pipe 41 is formed with an on-off valve (third on-off valve) 43.

The above power generation system 20A includes a control unit 35. The control unit 35 controls the supply of the heat medium of the heat medium circuit 21, the operation of the circulation pump 23 of the medium circuit 22, and the operation of the on-off valves 40A, 40B, and 43, and monitors the operating states or the like of respective devices that constitute the power generation system 20A.

Additionally, the control unit 35 includes an operating time measuring unit 36 that measures an integrated value of the operating time of a device to be periodically maintained, for example, the turbine 26, an operating time monitoring unit 37 that monitors the integrated value of the operating time of the turbine 26 measured in the operating time measuring unit 36.

The operating time monitoring unit 37 outputs an alarm signal showing that maintenance is required if the integrated value of the operating time of the turbine 26 reaches a predetermined specified value. Additionally, the control unit 35 can similarly output an alarm signal that maintenance (checking) is required when a certain abnormality is detected in the turbine 26, in addition to the above operating time.

As the alarm signal, for example, suitable methods, such as lighting of an indicator lamp and generation of an alarm sound, may be adopted.

On a user side of the power generation system 20A, the turbine 26 is maintained as follows if the alarm signal is output.

In the power generation system 20A described above, in order to maintain a turbine 26, first, the supply of the heat medium is stopped by a pump (not shown) or an on-off valve (not shown) of the heat medium circuit 21, and the circulation pump 23 of the medium circuit 22 is stopped.

Next, the on-off valves 40A and 40B are closed. Accordingly, the medium circuit 22 is shut off on the upstream side and the downstream side of the turbine 26.

Then, the on-off valve 43 is opened after a medium recovery device 100 configured to recover the medium is connected to the service port 42 of the port pipe 41. Accordingly, the media between the on-off valve 40A and 40B are recovered in the medium circuit 22.

After that, required maintenance can be performed for the turbine 26. The maintenance includes, for example, replacement of seal members, checking of damage to blades, repair of damaged portions, checking and replacement of various sensors, or the like. In addition, here, the maintenance contents of the turbine 26 are not limited at all.

By connecting a vacuum pump to the service port 42 and actuating the vacuum pump 110 after the end of the maintenance of the turbine 26, the inside of the medium circuit 22 between the on-off valves 40A and 40B is vacuumed. In the vacuum pump 110, the on-off valve 43 is closed after the vacuuming is performed up to a predetermined specified degree of vacuuming.

Then, a medium supply device 120 is connected to the service port 42, the on-off valve 43 is opened, and the inside of the medium circuit 22 is filled with the medium.

After the filling with the medium, the on-off valve 43 is closed and then the on-off valves 40A and 40B are opened.

Accordingly, since the power generation system 20A is brought into a restartable state, the pump (not shown) of the heat medium circuit 21 and the circulation pump 23 of the medium circuit 22 are actuated, and the power generation system 20A is restarted in a predetermined procedure.

According to the configuration as described above, the on-off valves 40A and 40B are provided on the upstream side and the downstream side of the turbine 26 serving as a maintenance target in the medium circuit 22, and the service port 42 is provided between the on-off valves 40A and 40B. Accordingly, during the maintenance of the turbine 26, the on-off valves 40A and 40B may be closed, and entering or leaving of the medium in only a partial section including the turbine 26 between the on-off valves 40A and 40B in the medium circuit 22 may be performed. Therefore, the time taken for the extraction or vacuuming of the medium or the filling with the medium can be shortened, and the operation rate of the power generation system can be enhanced by shortening a maintenance period. Additionally, since a small amount of a medium is also required during maintenance, maintenance costs can be reduced.

Additionally, the control unit 35 is adapted so as to measure the operating time of the turbine 26 and is adapted so as to output an alarm signal that maintenance is required when a specified operating time is reached. Therefore, maintenance can be performed for the turbine 26 at a suitable timing.

Meanwhile, in the above embodiment, the turbine 26 has been shown as a maintenance target device. However, the invention is not limited to this. Devices other than the turbine 26 can also be targets to be maintained if the devices are devices that constitute the power generation system 20A. In that case, the on-off valves 40A and 40B and the service port 42 may be configured so as to be provided a maintenance target device, similar to the above embodiment.

Second Embodiment

Next, a second embodiment of a power generation system and a maintenance method for a power generation system according to the invention will be described. In addition, in the second embodiment to be described below, the same components as those of the first embodiment will be designated by the same reference numerals in the drawings, and the description thereof will be omitted.

Figure 2:
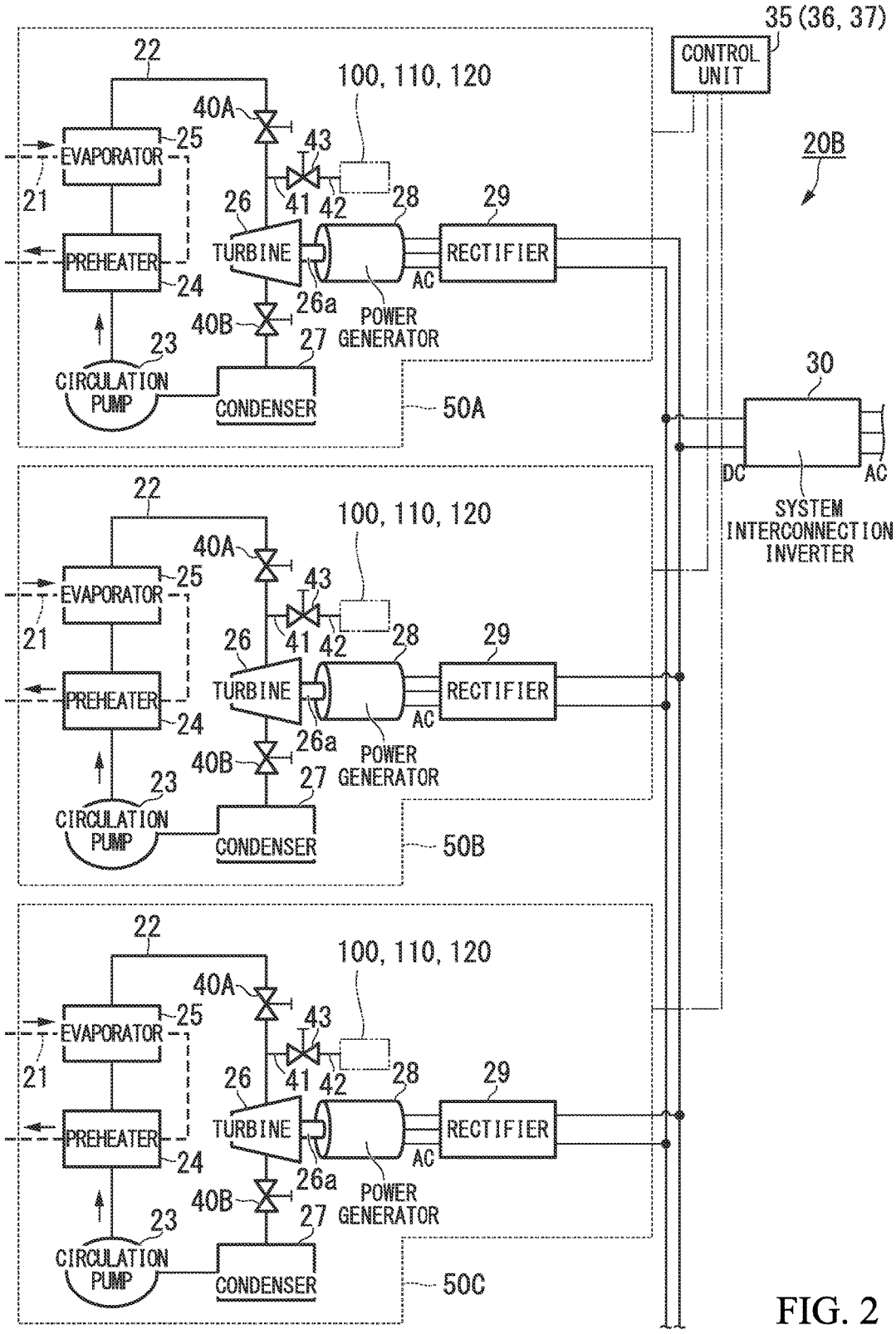
FIG. 2 is a view showing the configuration of a power generation system according to a second embodiment of the invention.

As shown in FIG. 2, a power generation system 20B according to the present embodiment includes a plurality of sets of power generation modules 50A, 50B, 50C, . . . .

Each of the power generation modules 50A, 50B, 50C . . . includes the heat medium circuit 21, the medium circuit 22, the circulation pump 23, the preheater 24, the evaporator 25, the turbine 26, the condenser 27, the generator 28, and the rectifier 29, which are the same as components shown in the above first embodiment.

The respective rectifiers 29 of the plurality of sets of power generation modules 50A, 50B, 50C, . . . are connected to one system interconnection inverter 30.

In such a power generation system 20B, in each of the power generation modules 50A, 50B, 50C, . . . , the circulation pump 23 circulates the medium within the medium circuit 22 so as to pass through the preheater 24, the evaporator 25, the turbine 26, and the condenser 27 in order. Then, a gas medium that is preheated in the preheater 24 and evaporated and gasified by the evaporator 25 expands within the turbine chamber of the turbine 26, thereby driving the generator 28. The generator 28 outputs an alternating current, and this alternating current is converted into a direct current in the rectifier 29 and is output to the system interconnection inverter 30.

Then, in the system interconnection inverter 30, the direct currents output from the rectifiers 29 of the plurality of power generation modules 50A, 50B, 50C, . . . are reconverted into an alternating current, and the converted alternating current is output to an external power grid as generated electric power.

In the above power generation system 20B, in each of the power generation modules 50A, 50B, 50C, . . . , similar to the above first embodiment, the on-off valves 40A and 40B are provided on the upstream side and the downstream side of a maintenance target device, for example, the turbine 26, and the port pipe 41 having the service port 42 and the on-off valve 43 are provided between the on-off valves 40A and 40B.

In each of the plurality of power generation modules 50A, 50B, 50C, . . . , the control unit 35 of the power generation system 20B controls the operation of the circulation pump 23 of the medium circuit 22, and the operation of the on-off valves 40A, 40B, and 43, and monitors the operating state of the respective devices that constitute the power generation system 20A, the operating time of the turbine 26, or the like.

Such a power generation system 20B is configured so as to selectively operate the plurality of power generation modules 50A, 50B, 50C, . . . , thereby changing the number of modules (that is, the number of turbines 26 to be operated) to be operated and stepwisely changing the amount of power generation, in accordance with the amount of input heat energy of the heat medium sent from the heat medium circuit 21 through the control of the control unit 35, or the amount of electric power required on an output side.

Additionally, the control unit 35 is adapted so as to preferentially stop operation from a turbine 26 having the longest operating time in the operating time monitoring unit 37 of the control unit 35 when the number of modules to be operated among the plurality of power generation modules 50A, 50B, 50C, . . . is reduced.

In order to maintain the turbine 26 in each of the power generation modules 50A, 50B, 50C . . . , as shown in the above first embodiment, first, the supply of the heat medium by the heat medium circuit 21 and the circulation of the medium by the circulation pump 23 of the medium circuit 22 are stopped in a module (for example, a power generation module 50A) equipped with a turbine 26 to be maintained among the plurality of power generation modules 50A, 50B, and 50C, . . . .

Next, the on-off valves 40A and 40B are closed. Then, the on-off valve 43 is opened after the medium recovery device 100 configured to recover the medium is connected to the service port 42 of the port pipe 41. Accordingly, the media between the on-off valve 40A and 40B are recovered in the medium circuit 22.

After that, required maintenance can be performed for the turbine 26. Then, by connecting the vacuum pump 110 to the service port 42 and actuating the vacuum pump 110 after the end of the maintenance of the turbine 26, the inside of the medium circuit 22 between the on-off valves 40A and 40B is vacuumed. Then, the on-off valve 43 is closed after the vacuuming is performed up to a specified degree of vacuuming. Next, the medium supply device 120 is connected to the service port 42, the on-off valve 43 is opened, and the inside of the medium circuit 22 is filled with the medium.

After the filling with the medium, the on-off valve 43 is closed and then the on-off valves 40A and 40B are opened. From this state, the power generation module 50A for which maintenance has been performed is restarted.

According to the configuration as described above, in each of the power generation modules 50A, 50B, 50C, . . . , the on-off valves 40A and 40B are provided on the upstream side and the downstream side of the turbine 26 serving as a maintenance target in the medium circuit 22, and the service port 42 is provided between the on-off valves 40A and 40B. Accordingly, during the maintenance of the turbine 26, the on-off valves 40A and 40B may be closed, and entering or departing of the medium in only a partial section including the turbine 26 between the on-off valves 40A and 40B in the medium circuit 22 may be performed. Therefore, the time taken for the extraction or vacuuming of the medium or the filling with the medium can be shortened, and the operation rate of the power generation system can be enhanced by shortening a maintenance period. Additionally, since a small amount of a medium is also required during maintenance, maintenance costs can be reduced.

Additionally, the control unit 35 is adapted so as to measure the operating time of the turbine 26 and is adapted to output an alarm signal that maintenance is required when a specified operating time is reached. Therefore, maintenance can be performed on the turbine 26 at a suitable timing.

Here, operation is preferentially stopped from a module equipped with a turbine 26 having the longest operating time through the control of the operating time monitoring unit 37 of the control unit 35 when the number of modules to be operated among the plurality of power generation modules 50A, 50B, 50C, . . . is reduced. Accordingly, the operating time of the turbine 26 can be constant, and maintenance intervals can be extended. Accordingly, maintenance can also be intensively and efficiently maintained by bringing the maintenance timings of all the turbines 26 close to each other.

Modified Example of Second Embodiment

Although a configuration in which the rectifiers 29 of the plurality of power generation modules 50A, 50B, 50C, . . . are connected to one system interconnection inverter 30 has been adopted in the above second embodiment, the invention is not limited to this. For example, in each of the plurality of power generation modules 50A, 50B, 50C, . . . , the rectifier 29 may include each system interconnection inverter 30.

Third Embodiment

Next, a third embodiment of a power generation system and a maintenance method for a power generation system according to the invention will be described. In addition, in the third embodiment to be described below, the same components as those of the first and second embodiments will be designated by the same reference numerals in the drawings, and the description thereof will be omitted.

Figure 3:
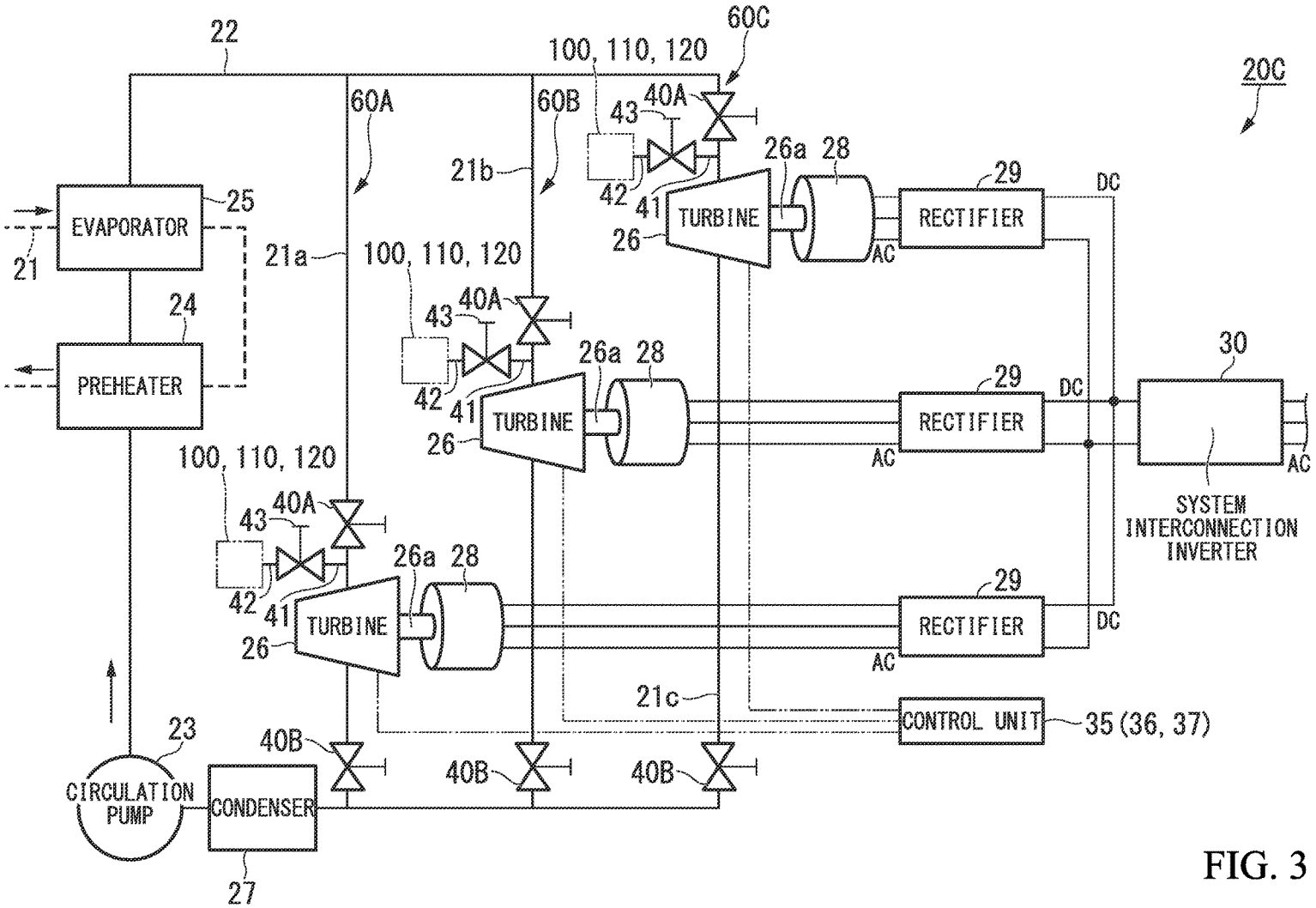
FIG. 3 is a view showing the configuration of a power generation system according to a third embodiment of the invention.
Figure 4:
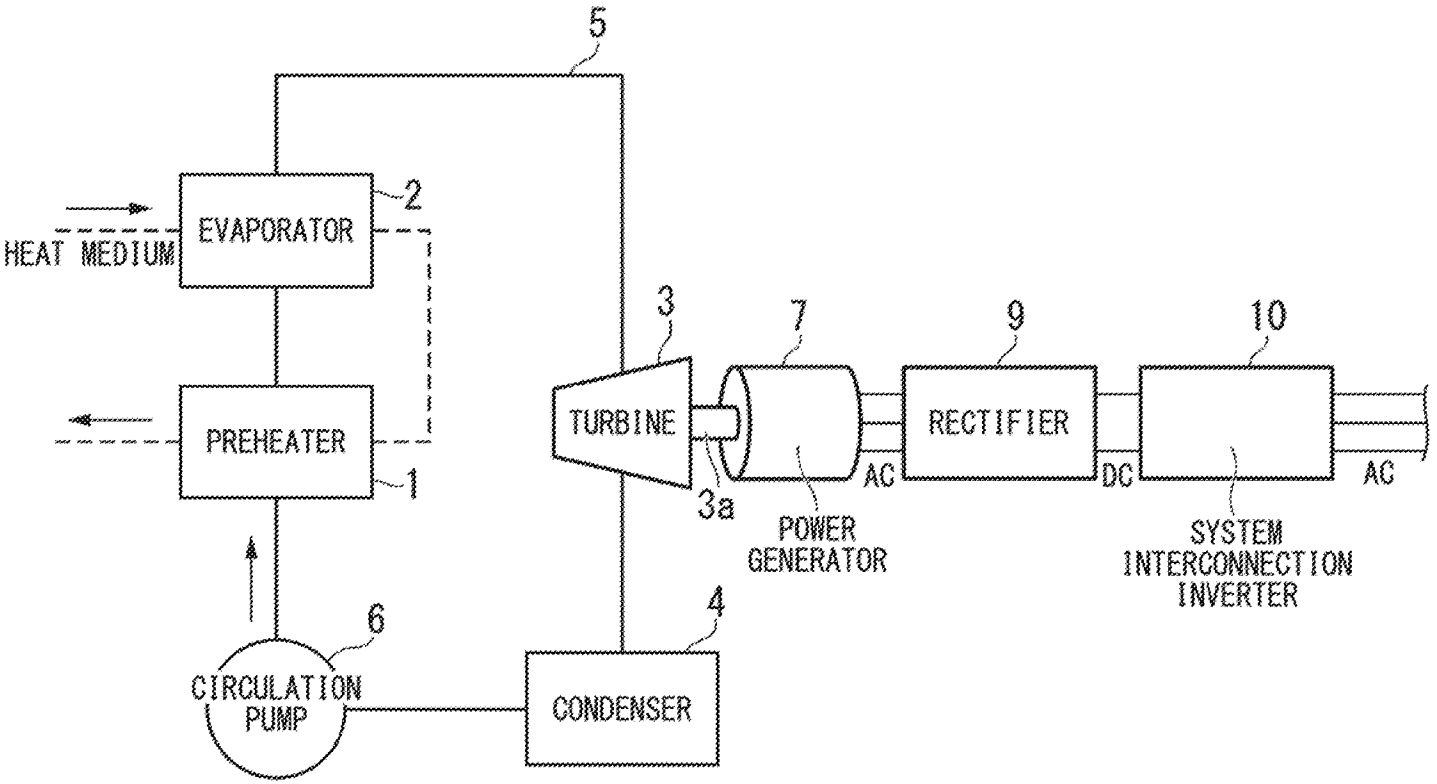
FIG. 4 PRIOR ART
FIG. 4 is a view showing the configuration of a related-art power generation system.

As shown in FIG. 3, a power generation system 20C according to the present embodiment includes a plurality of sets of power generation modules 60A, 60B, 60C, . . . .

The power generation system 20C includes a set of the medium circuit 22, the circulation pump 23, the preheater 24, the evaporator 25, and the condenser 27 with respect to one heat medium circuit 21. In the power generation system 20C, the heat medium circuit 21 branches into a plurality of branched pipes 21*a*, 21*b*, 21*c*, . . . between the evaporator 25 and the condenser 27. The power generation modules 60A, 60B, 60C, . . . are formed by each of the branched pipes 21*a*, 21*b*, 21*c*, . . . being provided with the turbine 26, the generator 28, and the rectifier 29.

The respective rectifiers 29 of the plurality of sets of power generation modules 60A, 60B, 60C, . . . are connected in parallel to one system interconnection inverter 30.

In the power generation system 20C having such a configuration, the medium sent out from the circulation pump 23 branches into the branched pipes 21*a*, 21*b*, 21*c*, . . . , of the power generation modules 60A, 60B, 60C, . . . , after passing through the preheater 24 and the evaporator 25, within the medium circuit 22. In each of the power generation modules 60A, 60B, 60C, . . . , this medium drives the turbine 26 to perform power generation using the generator 28, and then returns to the circulation pump 23 through the condenser 27 in order.

Then, in the system interconnection inverter 30, the direct currents output from the rectifiers 29 of the plurality of power generation modules 60A, 60B, 60C, . . . are reconverted into an alternating current, and the converted alternating current is output to an external power grid as generated electric power.

Such a power generation system 20C, similar to the above second embodiment, is also configured so as to be able to change the number of modules to be operated among the plurality of power generation modules 60A, 60B, 60C, . . . and stepwisely changes the amount of power generation, in accordance with the amount of heat energy of the heat medium sent from the heat medium circuit 21 through the control of the control unit 35, or the amount of electric power required on an output side.

Additionally, the control unit 35 is adapted so as to preferentially stop operation from a module equipped with the turbine 26 having the longest operating time when the number of modules to be operated among the plurality of power generation modules 60A, 60B, 60C, . . . is reduced.

In the above power generation system 20C, in each of the power generation modules 60A, 60B, 60C, . . . , similar to the above first embodiment, the on-off valves 40A and 40B are provided on the upstream side and the downstream side of a maintenance target device, for example, the turbine 26. Additionally, in the medium circuit 22, the port pipe 41 equipped with the service port 42 and the on-off valve 43 is provided between the on-off valves 40A and 40B.

In order to maintain the turbine 26 in each of the power generation modules 60A, 60B, 60C, . . . , the on-off valves 40A and 40B are closed in a module (for example, the power generation module 50A) equipped with a turbine 26 to be maintained among the plurality of power generation modules 60A, 60B, 60C, . . . . Then, the on-off valve 43 is opened after the medium recovery device 100 configured to recover the medium is connected to the service port 42 of the port pipe 41. Accordingly, the media between the on-off valve 40A and 40B are recovered.

After that, required maintenance can be performed for the turbine 26. Then, after the end of the maintenance of the turbine 26, the service port 42 is connected to the service port 110 and thereby the inside of the medium circuit 22 between the on-off valves 40A and 40B is vacuumed up to a specified degree of vacuuming, and then the on-off valve 43 is closed. Then, the medium supply device 120 is connected to the service port 42, the on-off valve 43 is opened, and the inside of the medium circuit 22 is filled with the medium.

After the filling with the medium, the on-off valve 43 is closed and then the on-off valves 40A and 40B are opened. From this state, for example, the power generation module 50A is restarted.

According to the configuration as described above, in each of the power generation modules 60A, 60B, 60C, . . . , during the maintenance of the turbine 26, the on-off valves 40A and 40B may be closed, and entering or leaving of the medium in only a partial section including the turbine 26 between the on-off valves 40A and 40B in the medium circuit 22 may be performed. Therefore, the time taken for the extraction or vacuuming of the medium or the filling with the medium can be shortened, and the operation rate of the power generation system can be enhanced by shortening the maintenance period. Additionally, since a small amount of a medium is also required during maintenance, maintenance costs can be reduced.

Moreover, the control unit 35 is adapted so as to preferentially stop operation from a module equipped with a turbine 26 having the longest operating time when the number of modules to be operated among the plurality of power generation modules 60A, 60B, 60C, . . . is reduced. Accordingly, the operating time of the turbine 26 can be constant, and maintenance intervals can be extended. Accordingly, maintenance can also be intensively and efficiently maintained by bringing the maintenance timings of all the turbines 26 close to each other.

Other Embodiments

In addition, the power generation system and the maintenance method for a power generation system in the invention are not limited to those of the above-described embodiments described with reference to the drawings, and various modification examples can be considered in the technical scope of the invention.

For example, in the power generation systems 20A, 20B, and 20C of the respective above embodiments, exhaust heat from vessels, factories, gas turbines, or the like, the heat of the earth, solar heat, temperature difference between cooler deep and warmer shallow ocean waters, and the like are used for power generation as heat sources. However, the types of the heat sources are limited.

Additionally, in the respective above embodiments, the turbine 26 is shown as an expander. However, a scroll-type expander or the like can also be adopted instead of the turbine 26.

Moreover, if procedures during maintenance are within the scope of the invention, the above-mentioned procedure can be appropriately changed.

In addition, the embodiments of the invention can be used not only when the chlorofluorocarbon media are used for power generation systems but also when media, the outflow of which to the outside of systems is to be avoided from a viewpoint of environmental preservation, are used for the power generation systems.

Additionally, the above second and third embodiments may include devices that store the operation time of a plurality of generators, and devices that display the operation time. In this case, the operation time may be displayed on display panels of power generation systems, or may be displayed on display panels outside power generation systems via the Internet. In this case, administrators or maintenance workers of the power generation systems can confirm the operation situations of respective generators and perform operation management or maintenance.

In addition to this, the configurations mentioned in the above respective embodiments can be adopted or eliminated or can be appropriately changed to other configurations.

INDUSTRIAL APPLICABILITY

According to the power generation system and the maintenance method for a power generation system, when a maintenance target device is maintained, it is not necessary to extract or vacuum the medium in the entire medium circuit. Thus, it is possible to shorten the maintenance period and enhance the operation rate of the power generation system.

REFERENCE SIGNS LIST

20A, 20B, 20C: Power Generation System
21: Heat Medium Circuit
21*a*, 21*b*, And 21*c*: Branched Pipe
22: Medium Circuit
23: Circulation Pump
24: Preheater
25: Evaporator
26: Turbine (Expander)
26*a*: Main Shaft
27: Condenser
28: Generator
29: Rectifier
30: System Interconnection Inverter
35: Control Unit
36: Operating Time Measuring Unit
37: Operating Time Monitoring Unit
40A: On-Off Valve (First On-Off Valve)
40B: On-Off Valve (Second On-Off Valve)
41: Port Pipe
42: Service Port (Port)
43: On-Off Valve (Third On-Off Valve)
50A, 50B, And 50C: Power Generation Module
60A, 60B, And 60C: Power Generation Module
100: Medium Recovery Device
110: Vacuum Pump
120: Medium Supply Device

The invention claimed is:

1. A maintenance method for a power generation system comprising:

a medium circuit comprising:

a circulation pump configured to circulate a medium with a boiling point lower than a boiling of water through the medium circuit;

an evaporator configured to heat the medium using heat of an external source and thereby evaporate the medium;

a plurality of expanders configured to be driven using the medium evaporated by the evaporator; and a condenser configured to condense the medium discharged from the expanders;

a generator configured to be driven by one of the expanders to generate power;

a control unit connected with the expanders; and a plurality of ports capable of communicating with the medium circuit;

wherein:

the medium circuit branches at a downstream side of the evaporator, each of the expanders corresponds to one of a plurality of branched pipes;

the branched pipes join at a downstream side of the expanders and at an upstream side of the condenser;

each of the branched pipes has a first on-off valve on the medium circuit at an upstream side of the corresponding expander, the first on-off valve being capable of shutting off flow of the medium through the medium circuit;

each of the branched pipes has a second on-off valve on the medium circuit at a downstream side of the corresponding expander, the second on-off valve being capable of shutting off flow of the medium through the medium circuit;

each of the ports has a third on-off valve, an end of each of the ports being connected to the corresponding branched pipe between the corresponding first on-off valve and the corresponding second on-off valve sandwiching the corresponding expander, and the control unit is configured to determine one maintenance target device to be maintained in accordance with an operation state of each of the expanders, the maintenance method comprising:

closing the corresponding first on-off valve on the upstream side of the one maintenance target device and the corresponding second on-off valve on the downstream side of the one maintenance target device;

opening the corresponding third on-off valve and recovering the medium between the corresponding first on-off valve and the corresponding second on-off valve after a medium recovery device that recovers the medium is connected to the corresponding port;

closing the corresponding third on-off valve after a section between the corresponding first on-off valve and the corresponding second on-off valve is vacuumed after maintenance of the one maintenance target device is completed; and connecting a medium supply device that supplies the medium to the corresponding port, opening the corresponding third on-off valve, and filling the section between the corresponding first on-off valve and the corresponding second on-off valve with the medium from the medium supply device.

2. The maintenance method for the power generation system according to claim 1, wherein the control unit comprises:

an operating time measuring unit configured to measure an integrated value of an operating time of the one maintenance target device, and an operating time monitoring unit configured to output a predetermined signal when the integrated value of the operating time of the one maintenance target device reaches a predetermined specified value.

3. The maintenance method for the power generation system according to claim 2, wherein the one maintenance target device is one of a plurality of maintenance target devices, wherein the control unit is configured to increase or reduce a number of the maintenance target devices to be operated in accordance with input from the external source or output from the generator, and wherein the control unit is configured to preferentially stop operation of one of the maintenance target devices in which the integrated value of the operating time of the one of the maintenance target devices is highest when the number of the maintenance target devices to be operated is reduced.

* * * * *